United States Patent [19]

Koshigoe et al.

[11] Patent Number: 4,885,505

[45] Date of Patent: Dec. 5, 1989

[54] ELECTRON GUN ASSEMBLY

[75] Inventors: Shinpei Koshigoe, Fukaya; Takeshi Fujiwara, Kumagaya, both of Japan

[73] Assignee: Kabushiki Kaisha Toshiba, Kawasaki, Japan

[21] Appl. No.: 235,719

[22] Filed: Aug. 22, 1988

Related U.S. Application Data

[63] Continuation of Ser. No. 939,888, Dec. 9, 1986, abandoned.

[30] Foreign Application Priority Data

Dec. 9, 1985 [JP] Japan ..... 60-274958

[51] Int. Cl.[4] ..... H01J 29/48

[52] U.S. Cl. ..... 315/3; 313/414; 313/449; 315/16

[58] Field of Search ..... 315/3, 15, 16; 313/409, 313/412, 414, 449, 452

[56] References Cited

U.S. PATENT DOCUMENTS

| | | | |
|---|---|---|---|
| 3,036,238 | 5/1962 | Stone et al. | 315/16 |
| 3,932,786 | 1/1976 | Campbell | 315/3 |
| 4,143,298 | 3/1979 | Bing et al. | 315/3 |
| 4,243,911 | 1/1981 | Winarsky et al. | 315/3 |
| 4,334,169 | 6/1982 | Takenaka et al. | 315/3 |
| 4,334,170 | 6/1982 | Rockwell | 315/16 |
| 4,349,767 | 9/1982 | Muramoto et al. | 313/414 X |
| 4,399,388 | 8/1983 | Hamano et al. | 313/414 |
| 4,620,134 | 10/1986 | Peels et al. | 315/414 X |
| 4,672,269 | 6/1987 | Kamohara et al. | 315/3 |

FOREIGN PATENT DOCUMENTS 61-218052 9/1986 Japan .

*Primary Examiner*—Howard W. Britton
*Assistant Examiner*—Mark R. Powell
*Attorney, Agent, or Firm*—Cushman, Darby & Cushman

[57] ABSTRACT

In an electron gun assembly, three electron beams emitted from cathode are focused by focusing electrodes and directed to accelerating electrodes through intermediate electrode. Three electron beams are converged on a predetermined point near a screen by accelerating electrodes. The accelerating electrodes are supplied with a first potential and are connected to a ground through a resistor and a stem pin. The intermediate electrodes are connected to the resistor and are maintained at a second potential. The focusing electrodes are connected to another stem pin and supplied with a third potential through another stem pin so that the third potential can be independently adjusted.

4 Claims, 3 Drawing Sheets

ELECTRON GUN ASSEMBLY

This is a continuation of application Ser. No. 939,888 filed Dec. 9, 1986 which was abandoned upon the filing hereof.

BACKGROUND OF THE INVENTION

This invention relates to an electron gun assembly for emitting three electron beams.

A cathode ray tube, such as an electron gun assembly of a color picture tube, generates three electron beams, which are directed onto a target screen coated with a phosphor layer, to cause the screen to emit light rays. To improve the image sharpness of the color picture tube, it is necessary to reduce the diameters of beam spots projected onto the screen, i.e., to improve the focusing characteristics of the electron guns, and to converge the three beams at a predetermined point near the screen.

An electron gun assembly essentially consists of an electron beam forming region for generating electron beams, and a main lens system for accelerating and focusing the beams onto target screen. Generally, the lens system is provided with means for converging the three electron beams at a predetermined point near the screen. Most of the lens system are electrostatic lenses, which are formed on an electron beam path by coaxially disposing a plurality of electrodes each having apertures, and applying predetermined potentials to the respective electrodes. Several types of lenses are employed, in accordance with the difference in the shapes of the electrodes and the voltages applied. There is a method for improving lens performance, by forming a large-aperture lens, through increasing the diameter of the aperture of the electrode. There is also a method of forming a long-focal length electron lens, by increasing the distance between electrodes, to provide a smooth change in potential. Since an electron gun for a cathode ray tube is sealed in a neck tube having a relatively small diameter, the size of the electrodes is therefore limited. Consequently, any increase in the size of the aperture of the electrode is also limited. As an interval Sg between electron guns is increased as the diameters of the apertures of the electrodes are increased, the electrical power, required for deflecting an electron beam, increases. Such an increase in power consumption is undesirable.

Since the electric field of the adjacent electrode and an undesired electric field from a neck wall affect the trajectory of the electron beams when the distance between the electrodes is merely lengthened, the distance cannot be increased without limit.

A method of increasing a distance between electrodes without affecting the electron beams from the above-mentioned undesired electric fields is disclosed in U.S. Pat. No. 3,932,786, granted to Campbell. Campbell discloses an electron gun assembly, for a color image tube, having bipotential lenses in a main lens system. More particularly, a number of metal plates are located, as intermediate electrodes, between the first and second focusing electrodes in the electron gun assembly disclosed in this U.S. Patent, the first and second focusing electrodes being connected via a ceramic film resistor, and the intermediate electrodes being coupled by resistors. Therefore, when an anode electrode voltage is applied from the anode of the second focusing electrode and a focusing voltage is applied from an external power supply to the first focusing electrode, a smooth potential gradient is formed from the first focusing electrode through the intermediate electrodes to the second focusing electrode, to form a long-focal length electron lens in which the distance between the first focusing electrode and the second focusing electrode has been increased.

However, this electron gun structure has the defects in that, if the focusing voltage applied to the first focusing electrode is adjusted, the potentials of the intermediate electrode are changed, and, as a result, misconvergence of the three electron beams (called "static misconvergence") occurs.

A method of converging three electron beams in a conventional electron gun assembly will now be described with reference to FIGS. 1 and 2.

FIG. 1 shows an example of a bipotential type electron gun assembly. Main lenses 63R, 63G, 63B are formed between first focusing electrodes 61 and second focusing electrodes 62. In this electron gun assembly, the opposing end faces of the electrodes corresponding to the side guns are formed obliquely with respect to the axes of the electron guns. Therefore, the electric fields for forming lenses 63R and 63B are formed asymmetrically with respect to the axes of the electron guns, and electron beams 65 and 66, passing through the side guns, are resultantly directed toward the center gun, so that three electron beams are converged at a predetermined point near the target screen. In the electron gun assembly shown in FIG. 2, central axis 67 of the aperture of second focusing electrode 62, corresponding to the side gun, offsets from central axis 68 of the aperture of first focusing electrode 61, in a direction away from central axis 69 of the center gun. Thus, the electric fields for forming the main lenses are formed asymmetrically with respect to the axes of the electron guns, i.e. the axes of the apertures of the electrodes, and the electron beams passing through the side guns are resultantly deflected toward the center gun, in the same manner as the case of FIG. 2, so that three electron beams are converged at a predetermined point near the target screen.

In U.S. Pat. No. 3,932,786, the method of converging the electron beams is not disclosed, but in order to display a clear image on the target screen, one of the above-mentioned methods must be employed in the main lens system. Therefore, it is assumed that in the electron gun structure disclosed in this U.S. Patent, as is shown in FIG. 2, the aperture axes of the second focusing electrodes of the side guns are offset from those of the intermediate electrodes thereof. An electron gun structure thus conceived has drawbacks in that, if the voltage applied to the first focusing electrodes is adjusted, the voltage of the intermediate electrodes is changed, so that the accuracy of convergence of the electron beam, i.e., static convergence, is degraded. In other words, this electron gun structure has the drawback in that the accuracy of convergence of the electron beams is affected by the adjusting of the focusing voltages, and, as a result, fine adjustment of the focusing and converging of the electron beams becomes difficult.

A method of correcting a misconvergence of the electron beam (static misconvergence), caused by the adjusting of the focusing voltages, is disclosed in U.S. Pat. No. 4,334,169, granted to Takenaka et al. U.S. Pat. No. 4,334,169 discloses a quadrapotential type electron gun assembled as shown in FIG. 3. In this assembly, an auxiliary lens is formed by third grid 71, fourth grid 72, and fifth grid 73, and a main lens is also formed, by fifth grid 73 and sixth grid 74. Furthermore, mounted the axes of the apertures corresponding to the side guns between fourth and fifth grids 72 and 73 and between fifth and sixth grids 73 and 74 offset from the axis between the third grid 71 and fourth grid 72 to converge the electron beams. A focusing voltage of about 7 kV is applied to third and fifth grids 71 and 73, a voltage of about 600 V is applied to fourth grid 72, and a voltage of about 25 kV is also applied to sixth grid 74.

If the focusing voltage is, for example, raised in the above-mentioned structure, the lens force of first auxiliary lens 80 is increased, and the deflecting force of the side beam is accordingly strengthened, while the lens force of second main lens 81 is weakened, and the deflecting force of the side beams is correspondingly weakened, so that a variation in static convergence is resultantly prevented.

When the focusing voltage decreases, a reverse phenomenon to the above occurs, so that a variation in static convergence is also prevented.

As has been described above, this electron gun assembly has a characteristic in that the static convergence is always maintained. However, it is necessary to offset the axes of the apertures of the side guns in the two regions. Therefore, the electrode structure forming the gun assembly is complicated, and the assembling and manufacturing of the assembly are thus also complicated.

Further, the side beams are deflected in two stages, and the electron beams pass through two lenses having electrical distortions, so that the distortions of the side beams consequently tend to increase. Therefore, the electron beam focusing performance of the center and side beams are not uniform, thereby sacrificing the focusing performance of the electron gun.

As has been described above, in the conventional electron gun assembly, the convergence of the electron beam is affected by the adjustment of the focusing voltage, and, as a result, fine adjustment of the focusing and converging of the electron beams becomes difficult. Furthermore, the electron gun assembly for eliminating the above drawbacks has another drawback, in that it is complicated in its structure.

SUMMARY OF THE INVENTION

An object of the present invention is to provide an electron gun assembly having a simple structure and good focusing characteristics.

According to the present invention, there is provided an electron gun assembly comprising:

cathode means for emitting three electron beams, accelerating electrodes for accelerating and converging the three electron beams onto a predetermined point, focusing electrodes for focusing the electron beams, intermediate electrodes located between the accelerating and focusing electrodes, first connecting means connected to the accelerating electrodes and supplied with a first predetermined voltage for maintaining the accelerating electrodes at a first potential, second connecting means connected to the focusing electrodes and supplied with a second predetermined voltage for maintaining the focusing electrodes at a second potential, lower than the first potential, and resistance means connected between the first connecting means and a ground potential, and connected to the intermediate electrodes, for maintaining the intermediate electrodes at a third potential, between the first and second potentials.

DETAILED DESCRIPTION OF THE PREFERRED EMBODIMENTS

Embodiments of this invention will be described in more detail with reference to the accompanying drawings.

Figure 4:
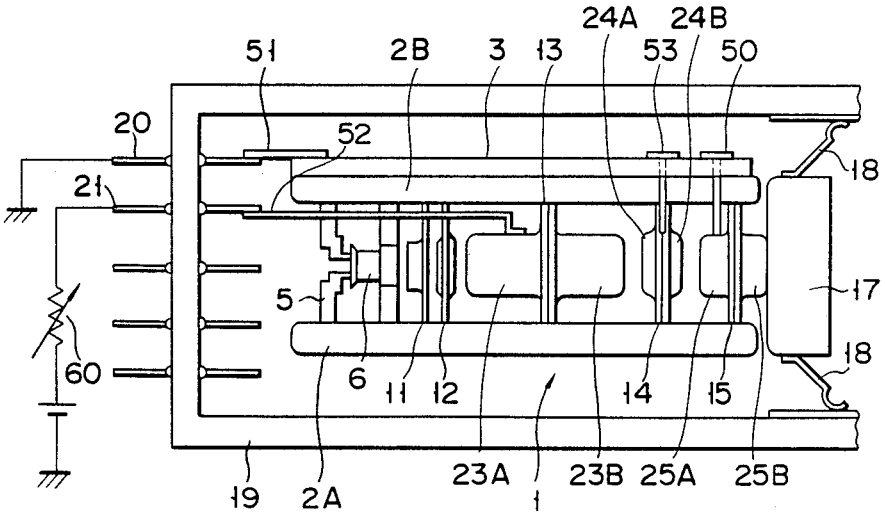
FIG. 4 is a sectional view showing an electron gun assembly according to an embodiment of this invention.
Figure 5:
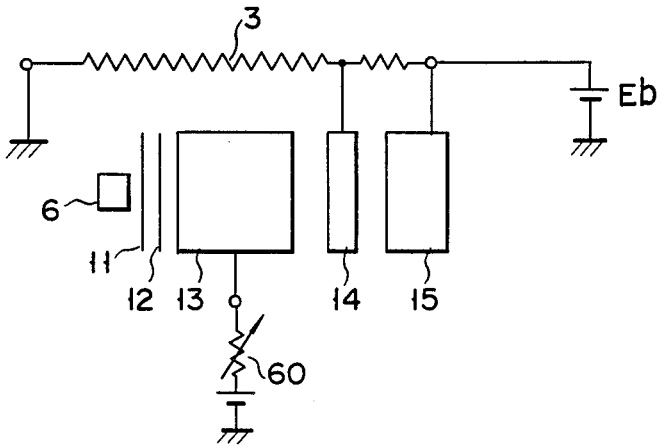
FIG. 5 is an equivalent circuit of an electron gun assembly showing the electric connection of the electron gun assembly shown in FIG. 4.

FIG. 4 is a schematic sectional view of a bipotential type electron gun assembly, which is received in a neck tube of a color cathode ray tube, according to an embodiment of this invention; and FIG. 5 is an equivalent circuit of an electric connection of the electron gun assembly of FIG. 4.

In FIG. 4, electron gun assembly 1 having a structure comprises a plurality of electrodes to be described later, two electrode supports 2A and 2B, and a resistor 3 for applying a predetermined potential to at least one electrode. Three heaters 5 for generating three electron beams which are landed on phosphor layers of red, green and blue colors are received in three cathodes 6, respectively. First second, third fourth and fifth grids 11, 12, 13, 14 and 15 and convergence electrode 17 of integral structure (unitized structure) are arranged in this order. Each grids is fixed to two supports 2A and 2B, and have apertures for passing the corresponding electron beams, which are arranged facing to the three cathodes. First and second grids 11 and 12 are plate-like electrodes located in the vicinity to one another, third grid 13 is formed of two cup-shaped electrodes 23A and 23B located in the vicinity of second grid 12, and fourth grid 14 is formed of two cup-shaped electrodes 24A and 24B located at a predetermined distance from third grid 13. Since fourth grid 14 is located between third and fifth grids 13 and 15 for forming a conventional bipotential type main lens, grid 14 is also called "intermediate or auxiliary electrodes". Fifth grid 15 is formed of two cup-shaped electrodes 25A and 15B located at a predetermined distance from fourth grid 14, and convergence electrode 17 is formed of a cupshaped electrode **27*a* welded to fifth grid 15. Resistor 3 of thin plate shape is mounted on the back surface of second support 2B. Bulb spacers 18 for supplying an anode electrode Eb of approx. 25 kV applied to an anode terminal, not shown, is mounted on convergence electrode 17. Such electron gun assembly 1 is sealed in a neck 19 formed of a glass cylinder having relative small diameter. A space of approx. 1.2 to 1.5 mm is provided between the neck wall and the electron gun electrodes so that the electrodes are not contacted with the inner wall of the neck. A plurality of stem pins 20, 21 are fixed to the base section of neck 19, and electron gun 1 is supported by stem pins 20, 21 together with spacers 18. Grid potentials are applied to the grids except electrode 17 and fifth grid 15 through stem pins 20, 21. Resistor 3 is connected at one end thereof to electrode 17 or fifth grid 15 through a connector 50, and at the other end thereof through connector 51 to a stem pin 20 applied with a ground potential. It is not always necessary to ground the ends of the resistor directly, but the resistor may be grounded through a power supply. Third grid 13 is connected through connector 52 to stem pins 21, and connected to a variable resistor 60 and further to a power supply in the exterior. At least one electrical tab is provided at a suitable intermediate point of resistor 3, and connected through a connector 53 to fourth grid 14 of the intermediate electrode. The electron gun arrangement can be expressed in a circuit arrangement shown in FIG. 5. The electrode potential of fourth grid 14 is applied as a dividing potential between a final electrode potential applied to fifth grid 15 and the ground potential applied to resistor 3**.

In the above-mentioned electrode arrangement, cathode 6 is held at a cut-off voltage of approx. 150 V, and a modulation signal is applied to the cathode. The same ground potential as one end of resistor 3 is applied to first grid 11, a potential of approx. 700 V is applied to second grid 12, a relatively low potential, such as approx. 6 to 8 kV, is applied to third grid 13, and a relatively high potential, such as approx. 25 kV, is applied to fifth grid 15 and convergence electrode 17. A intermediate potential, such as approx. 16 kV, is applied to fourth grid 14 of the intermediate electrode as a dividing potential between the ground potential and final electrode potential of approx. 25 kV from resistor 3. With such electrode arrangement, an electrostatic lens having a long focal length is formed to reduce an electron optical magnification and a spherical aberration, thereby improving the lens performance.

Figure 3:
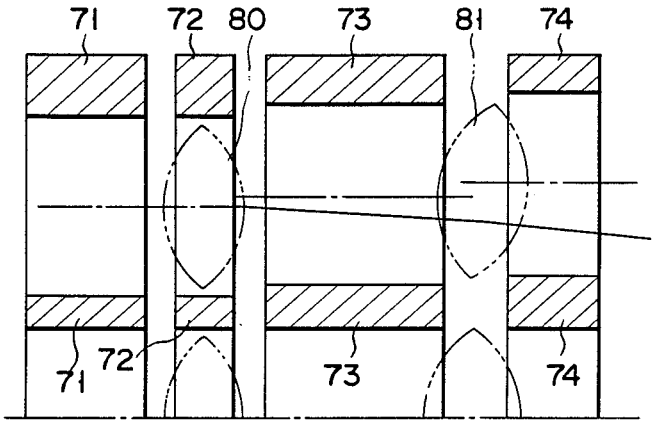
FIG. 3 is a sectional view schematically showing an electrode structure in a quadrapotential type electron gun.

Static convergence of the electron gun assembly of this invention is formed by a main lens as shown in FIG. 3 between fifth grid 15 of the final electrode and fourth grid 14 of the intermediate electrode. Since fourth and fifth grids 14 and 15 are electrically independent from third grid 13 of the focusing electrode, even if the focusing voltage of third grid 13 is adjusted, a variation in the lens force formed between fourth and fifth grids 14 and 15 is reduced to the degree substantially to be ignored. Therefore, the deflecting force applied to the electron beam passing the side guns, i.e., the static convergence action is not substantially altered and is substantially maintained in constant.

Figure 1:
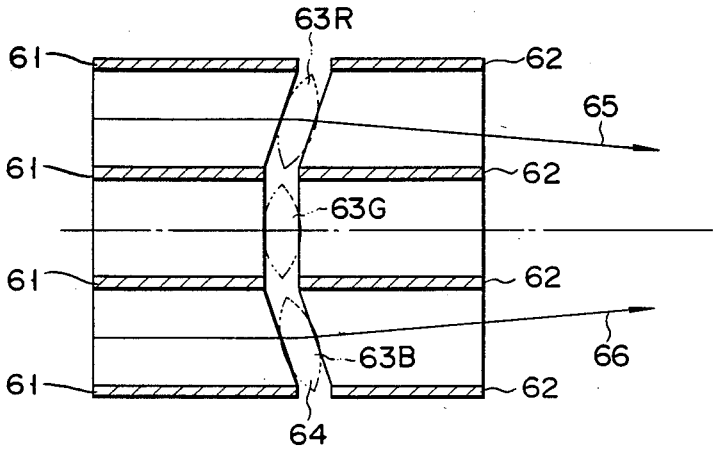
FIG. 1 (PRIOR ART)
FIG. 1 is a sectional view schematically showing an electrode structure for generating an electrostatic lens system in a bipotential type electron gun assembly.
Figure 2:
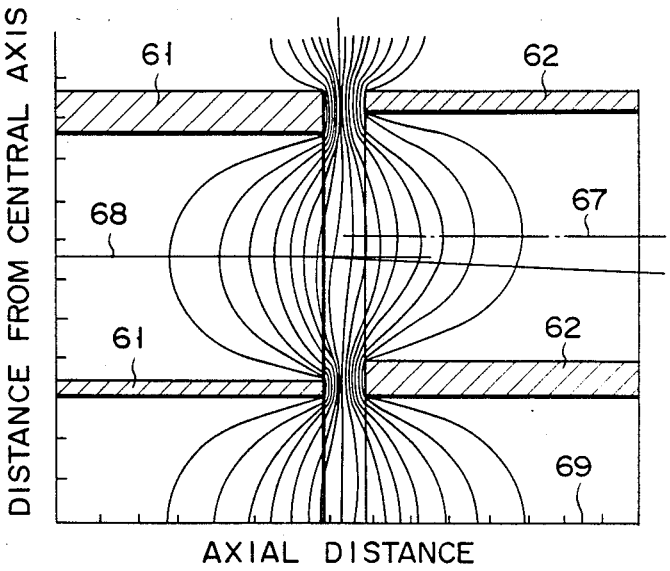
FIG. 2 (PRIOR ART)
FIG. 2 is a sectional view schematically showing an electrode structure different from that of FIG. 1.

As described above, the electron gun assembly of this invention has a simple structure as compared with the conventional electron gun assembly in FIG. 2, and can be readily assembled and manufactured. Further, the electron gun assembly of the invention can eliminate the distortions of the side beams due to the elimination of two stage deflections of the electron beams, but can provide uniform and good focusing performance of the focusing performance of the three beams.

Additionally, since fourth and fifth grids 14 and 15 are electrically connected through resistor 3, when the total resistance value of resistor 3 is sufficiently increased to approx. 500 megohms to 5 gigaohms, an arc discharge between the electrodes can be prevented as compared with the conventional electron gun assembly in which the main lens is formed by merely opposing the electrodes. In the conventional electron gun assembly which does not employ a resistor, when an arc discharge occurs between the electrodes, a rush current having large level, such as 500 to 1000 Å flows to a receiver circuit through stem pins. However, the electron gun assembly according to the invention the rush current can be suppressed to an extremely small current, such as several microamperes to several amperes. Thus, the influence to the receiver circuit can be sufficiently alleviated. Resultantly, circuit protecting elements, such as inductances, capacitors and resistors for protecting the circuit against the rush current produced due to the arc discharge as employed in almost all receiver circuit at present can be omitted, and a television receiver can be simplified, thereby improving the reliability.

Figure 6:
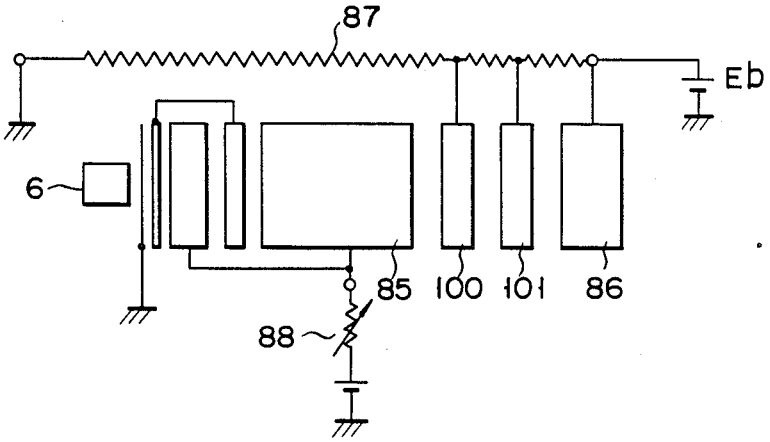
FIG. 6 is an equivalent circuit of an electron gun assembly according to another embodiment of this invention different from that of FIG. 5.

In the embodiment described above, an example of a bipotential type electron gun has been described. However, the connecting method of the resistors of this invention may be also applied to an electron gun having other lens type, such as a unipotential type electron gun, and a multistage focusing type electron gun so called "a quadrapotential type". An electric circuit diagram of another embodiment of this invention applied to a quadrapotential type electron gun is shown in FIG. 6. In an electron gun assembly shown in FIG. 6, the above-mentioned intermediate electrode is mounted between fifth grid 85 and sixth grid 86. In an electron gun assembly shown in FIG. 6, an example having two intermediate electrodes is shown. The intermediate electrode may be one or three or more. Resistor 87 is connected at one end thereof to sixth grid 86 of an accelerating electrode as described above, and at the other end thereof to a ground potential. Dividing potential of anode potential Eb and the ground potential by resistor 87 is applied to intermediate electrodes 100 and 101. A focusing potential is externally applied through stem pins, not shown, to fifth grid 85 of focusing electrode. If the deflecting center of the side guns as shown in FIG. 4 is provided, for example, between intermediate electrode 101 and sixth grid 86, even if a focusing potential applied to fifth grid 85 is adjusted, static convergence can be not entirely altered.

In the embodiments described above, three electron guns are arranged in an in-line type electron gun. However, this invention is not limited to the particular embodiments. For example, this invention can be also applied to a delta type electron gun in which three electron guns are arranged in a triangular shape. According to this invention as described above, an electron gun assembly having high performance of long focal length, excellent focusing performance, no variation in static convergence due to focusing potential adjustment and high practicability can be provided.

Further, since the electron gun assembly of the invention can perform a good breakdown voltage performance to eliminate an arc discharge between the electrodes, enhance the reliability of a color image tube and can eliminate elements such as resistors and coils used to protect the circuits of a television receiver against a rush current produced due to the arc discharge, the invention can reduce the number of components of the television receiver and improve the reliability.

What is claimed is:

1. An electron gun assembly comprising:

a cathode means for emitting three electron beams;

a focusing electrode disposed adjacent to said cathode means for focusing the three beams;

an intermediate electrode disposed adjacent to said focusing electrode;

an accelerating electrode for accelerating the electron beams disposed adjacent to said intermediate electrode;

a resistor having first and second ends and an intermediate terminal point there between, the second end being connected to the accelerating electrode and the intermediate terminal point being connected to the intermediate electrode;

means for supporting the cathode means, said electrode arrangement and resistor;

means for receiving the cathode means, said electrode arrangement and the resistor;

first and second stem pins fixed to said receiving means, the first end of said register being connected to ground via the first stem pin and the second stem pin being connected to the focusing electrode;

means, connected to the second end of said resistor, for applying a first voltage to said resistor through the second end of said resistor to maintain the accelerating and intermediate electrode at accelerating and intermediate potentials, respectively, thereby forming static electricity lenses between the accelerating and intermediate electrodes to accelerate and converge the three electron beams at a predetermined point; and means, connected to the second stem pin, for applying a second voltage to the focusing electrode to maintain the focusing electrode at a focusing potential, thereby forming static electricity lenses between the focusing electrode and the intermediate electrode to focus the three electron beams, respectively, said convergence of said three electron beams being unchanged in response to said second voltage being applied to said focusing electrode.

2. An electron gun assembly according to claim 1, further comprising an adjusting means for adjusting said second voltage applied to the focusing electrodes.

3. An electron gun assembly according to claim 1, further comprising:

a neck section in which said cathode means, said focusing electrode, said intermediate electrode, and resistor means are housed.

4. An electron gun assembly according to claim 1, further comprising:

a neck section in which said cathode means, said focusing electrode, said intermediate electrode, and said resistor means are housed.

* * * * *